United States Patent [19]

Hodge

[11] 4,037,672

[45] July 26, 1977

[54] SHAFT DRILL BREAK-OUT SYSTEM

[75] Inventor: Lee Roy Hodge, Houston, Tex.

[73] Assignee: Hughes Tool Company, Houston, Tex.

[21] Appl. No.: 546,856

[22] Filed: Feb. 4, 1975

Related U.S. Application Data

[63] Continuation-in-part of Ser. No. 497,172, Aug. 12, 1974, Pat. No. 3,942,592.

[51] Int. Cl.[2] ..... E21D 9/02; E02D 7/28; E21B 19/16

[52] U.S. Cl. ..... 173/157; 81/57.16; 81/57.22; 173/164; 175/85

[58] Field of Search ..... 173/164, 157; 175/85; 81/57.15, 57.16, 57.22

[56] References Cited

U.S. PATENT DOCUMENTS

| | | | |
|---|---|---|---|
| 3,330,164 | 7/1967 | Wilson | 173/163 X |
| 3,460,638 | 8/1969 | Millsapps, Jr. | 175/85 |
| 3,625,095 | 12/1971 | Barnett et al. | 81/57.22 X |
| 3,680,412 | 8/1972 | Mayer | 81/57.16 X |
| 3,719,236 | 3/1973 | Smith, Jr. | 81/57.22 X |

*Primary Examiner*—Ernest R. Purser
*Assistant Examiner*—William F. Pate, III
*Attorney, Agent, or Firm*—Robert A. Felsman

[57] ABSTRACT

An improved shaft drill break-out system is disclosed that utilizes three separate out-put torques for the power swivel used to break-out, make-up and rotate the drill stem and attached drill bit for earth boring. When removing drill stem from the hole, the power swivel is tightened to the upper end of the drill stem with the largest torque. Thus, when the upper section of drill stem is lifted for breaking the bottom connection from the next lower section of drill stem, it is assured that this bottom connection will be broken since when going in the hole this connection was made-up with the intermediate torque. The lowest torque is used for drilling. As a consequence, sufficient torque for break-out is assured with proper selection of each of the three torques. Additionally disclosed are break-out arms and a slip assembly adapted for selected engagement with vertical slots in the drill stem to facilitate make-up and break-out.

4 Claims, 3 Drawing Figures

SHAFT DRILL BREAK-OUT SYSTEM

CROSS-REFERENCE TO RELATED APPLICATION

This application is a continuation-in-part of my copending application, DRILL STEM MAKE-UP AND BREAK-OUT SYSTEM FOR EARTH DRILLING MACHINES, Ser. No. 497,172, filed Aug. 12, 1974, Pat. No. 3,942,592.

BACKGROUND OF THE INVENTION

1. Field of the Invention:

This invention relates in general to earth boring machines, particularly shaft drills that typically use a hydraulic system, electrically controlled, for moving the drill stem and a large diameter drill bit. The invention especially relates to those components of such machines used to make-up and break-out the drill stem sections when inserting or removing drill stem from the bore hole.

2. Description of the Prior Art:

There are commercially available machines which utilize hydraulic cylinders to forcibly move in a linear, upward or downward direction a power swivel, which is commonly driven by a hydraulic motor and pump. When adding or subtracting a drill stem member to the total string of such members, the power swivel is rotated while back-up means hold a portion of the drill string to cause make-up or break-out of a selected, threaded connection of the drill stem. The power swivel is threaded to connect to an upper end of a drill stem memmber, and a back-up device must engage and hold the drill stem member while the power swivel is rotated such that its threads engage and mate with those of the drill stem. The prior art includes a number of machines falling within this general description. There still remains, however, a need for better solution to some of the problems existing with these machines. There is a need, for example, for an improved system that assures in a simple but reliable manner that the lower connection of a drill stem, and not the connection with the power swivel, will break-out when removing the drill stem from the bore hole. Further, there is a need for improvement of the means used to grip and engage the drill stem for back-up so that the entire drill stem is prevented from rotating while making up or breaking-out a selected connection.

SUMMARY OF THE INVENTION

This invention is directed to an improved make-up and break-out system that may be utilized in conjunction with the invention disclosed in my copending application. The present invention utilizes three separate output torques of the power swivel. The largest torque is for break-out procedures, intermediate torque used for make-up, and the smallest torque used for drilling. Since the make-up and drilling torques are less than the break-out torque, break-out of the threads forming the connections between drill stem members and between the upper drill stem member and the power swivel is assured. The three output torques are produced by providing the hydraulic pump which energizes the power swivel motor with three pressure compensators, each of which when activated limits the pressure output of the pump to a selected value. The three, selectable pressure outputs of the pump result in three separate hydraulic pressures being available at the power swivel motor to establish the three previously disccussed output torques of the power swivel. As a consequence, even if additional make-up or tightening of the connection between drill stem members occurs during drilling, the break-out torque will be sufficient to separate the connections. A sequence of operations is utilized when removing pipe from the hole to make-up the connection between the upper drill stem member and power swivel with the maximum torque. This insures that when the upper section of the drill stem is lifted and rotated with respect to the next, lower drill stem member, break-out will occur at their connection and not between the power swivel and the upper end of the top drill stem member. Another aspect of the invention is the use of break-out arms carried by the power swivel carriage having fingers that engage vertical slots in the drill stem. Further, reciprocable slips around the drill stem and located on the working table of the machine have fingers to also engage vertical slots and the drill stem. Hence, large forces may be transmitted to the fingers in the pipe without deformation or other damage between these components.

The above as well as other objects, features and advantages of the invention will become more fully apparent in the following description of the preferred embodiment.

DESCRIPTION OF THE PREFERRED EMBODIMENT

Figure 1:
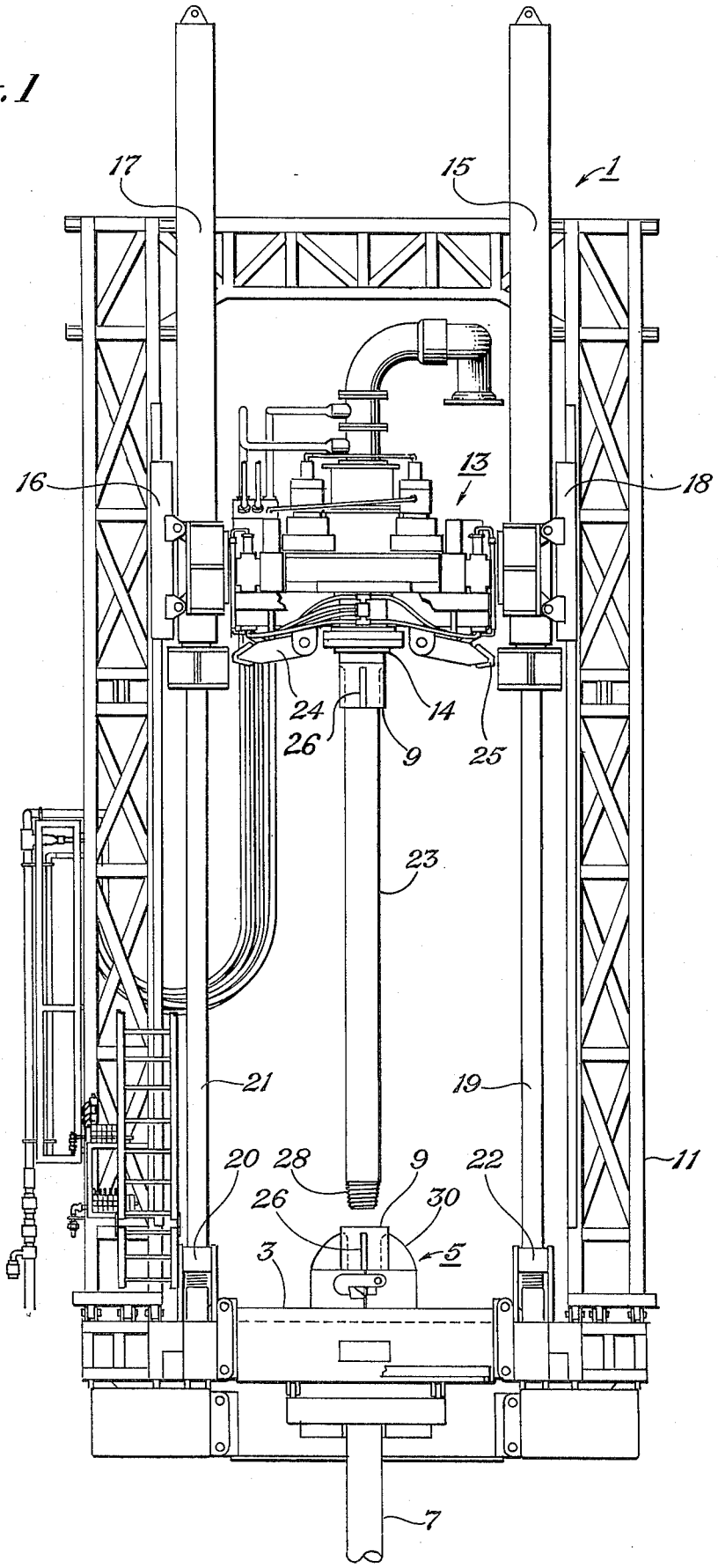
FIG. 1 is a front elevation view of a shaft drill constructed in accordance with the principles of the invention.
Figure 2:
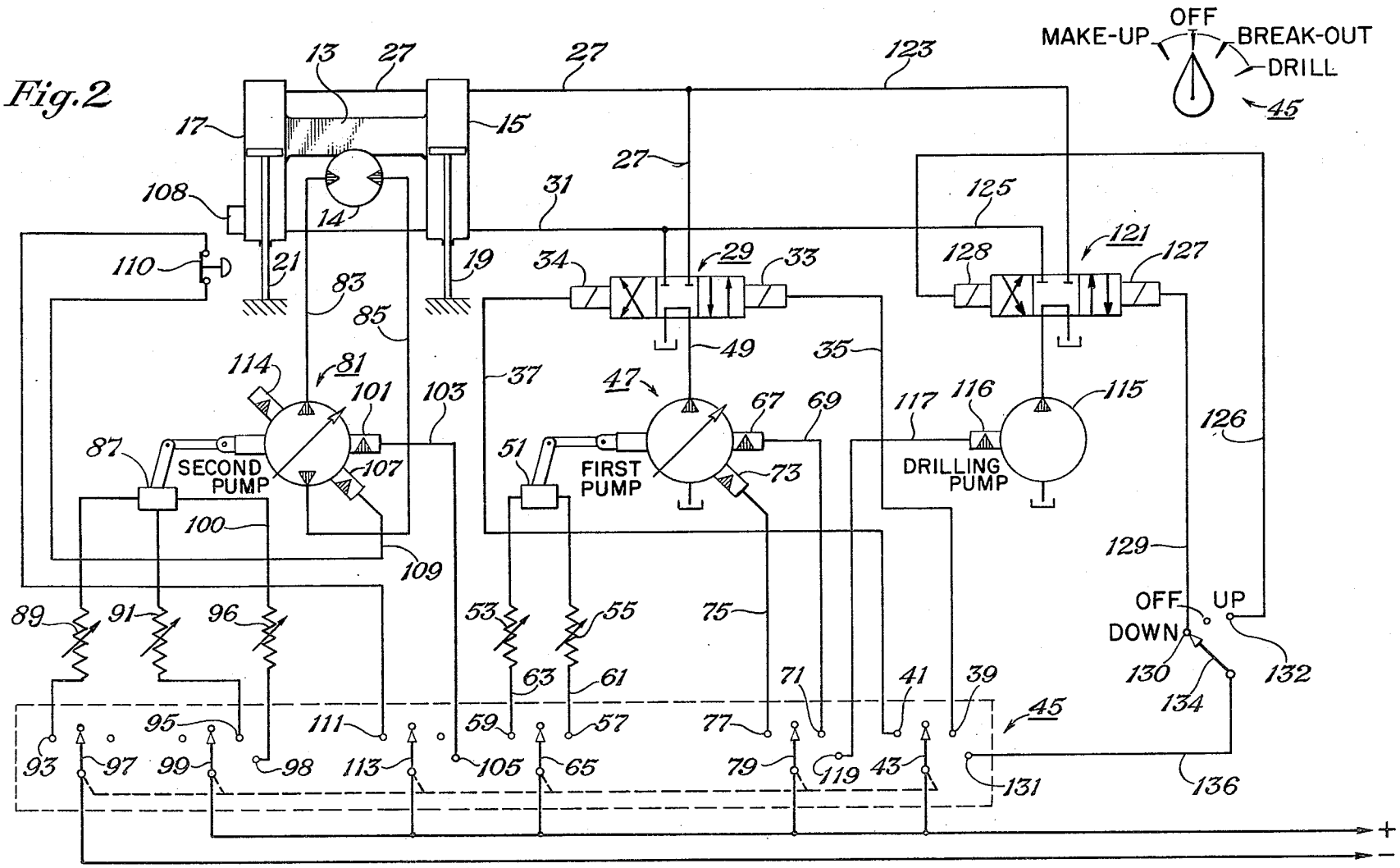
FIG. 2 illustrates schematically a combined electro-hydraulic system used in connection with the shaft drill shown in FIG. 1.

Referring initially to FIG. 1, the numeral 1 in the drawing designates a shaft drilling machine having a work table 3 supporting horizontally reciprocable slips 5, the construction of which will be fully explained hereinafter. A drill stem section 7 is shown supported by its collar 9. Mast 11 extends upward from the table 3 to support a cross-member 13 powered for reciprocal movement along the masts by a pair of hydraulic cylinders 15, 17 attached to guides 16, 18. The piston ends 19, 21 extend from the cylinders into attachment with the table 3. The numerals 20, 22 indicate jack screws for controlling mast inclination. A rotatable power swivel 14 is threadedly connected with another drill string section 23. Breakout arms 24 have fingers 25 adapted to move into engagement with the slots 26 of a collar or box which receives a pin (not shown) threaded and formed on the power swivel. The lower end of the drill string section 23 is threaded in the form of a pin 28 to engage a mating box or Slips 9 formed on the lower drill stem section 7. Slops 5 have fingers 30 adapted to engage the slots 26 of the collar 9. A hydraulic line 27 is connected with the housings of the cylinders and to a valve means 29, which as shown in FIG. 2 is a four-way, three-position solenoid operated directional valve of conventional construction. The solenoids 33, 34 are connected by conductors 35, 37, respectively to two terminals 39, 41, adapted to be opened or closed by a pole 43 of a switch designated generally by the numeral 45.

A first pump means 47, which is a variable displacement hydraulic pump, is connected by hydraulic line 49 to the valve means 29. The output volume of this pump is determined by an electro-mechanical servo pump controller which as shown in FIG. 2 comprises a first control means 51, a first variable resistor 53 to determine a selected make-up linear speed for the power swivel, and a second variable resistor 55 to determine a selected break-out linear speed for the power swivel. These resistors are connected to terminals 59, 57 respectively through electrical conductors 63, 61. A pole 65 is adapted to supply current through either resistor 53 or resistor 55. A first electrical solenoid activated pressure compensator control 67 is connected through conductor 69 to terminal 71. A second electrical solenoid activated pressure compenstor 73 is connected by conductor 75 through terminal 77. A pole 79 is adapted to close with terminal 71 or 77 to energize either the first pressure compensator 67 or the second pressure compensator 73 associated with the first pump means 47.

A second, variable volume and also reversible pump 81 is connected hydraulically with power swivel 14 by hydraulic lines 83, 85. A second control means 87, which is also a pump volume control actuator of the electromechanical servo type is electrically controlled by a pair of variable resistors 89, 91 to terminals 93, 95 of the switch 45, which may be closed by the poles 97, 99. Another variable resistor 96 connects the control means 87 with a terminal 98 through conductor 100.

An electrical solenoid activated pressure compensator control 101 comprises a first pressure compensator control means associated with the second pump 81 and connected with a conductor 103 to a terminal 105. A second such pressure compensator control 107 is connected by conduit 109 through a mechanically actuated switch 110 to a terminal 111. The pole 113 is adapted to close terminal 111 or 105 in the switch 45. A third pressure compensator control 114 sets the upper or maximum pressure of the pump when neither compensator 101 or 107 is activated.

A drilling pump 115 and its solenoid activated pressure compensator 116 is connected by a conductor 117 with terminal 119. The hydraulic output of pump 115 supplies a four-way, three-position valve 121, which selectively directs fluid to or from the hydraulic cylinders 15, 17 through lines 123, 125 connected respectively with lines 27, 31. The valve 121 is operated with solenoids 127, 128 connected by conductors 129, 126 respectively with the terminals 130, 132 of a switch having a pole 134 connected by conductor 136 with terminal 131 of switch 45.

Figure 3:
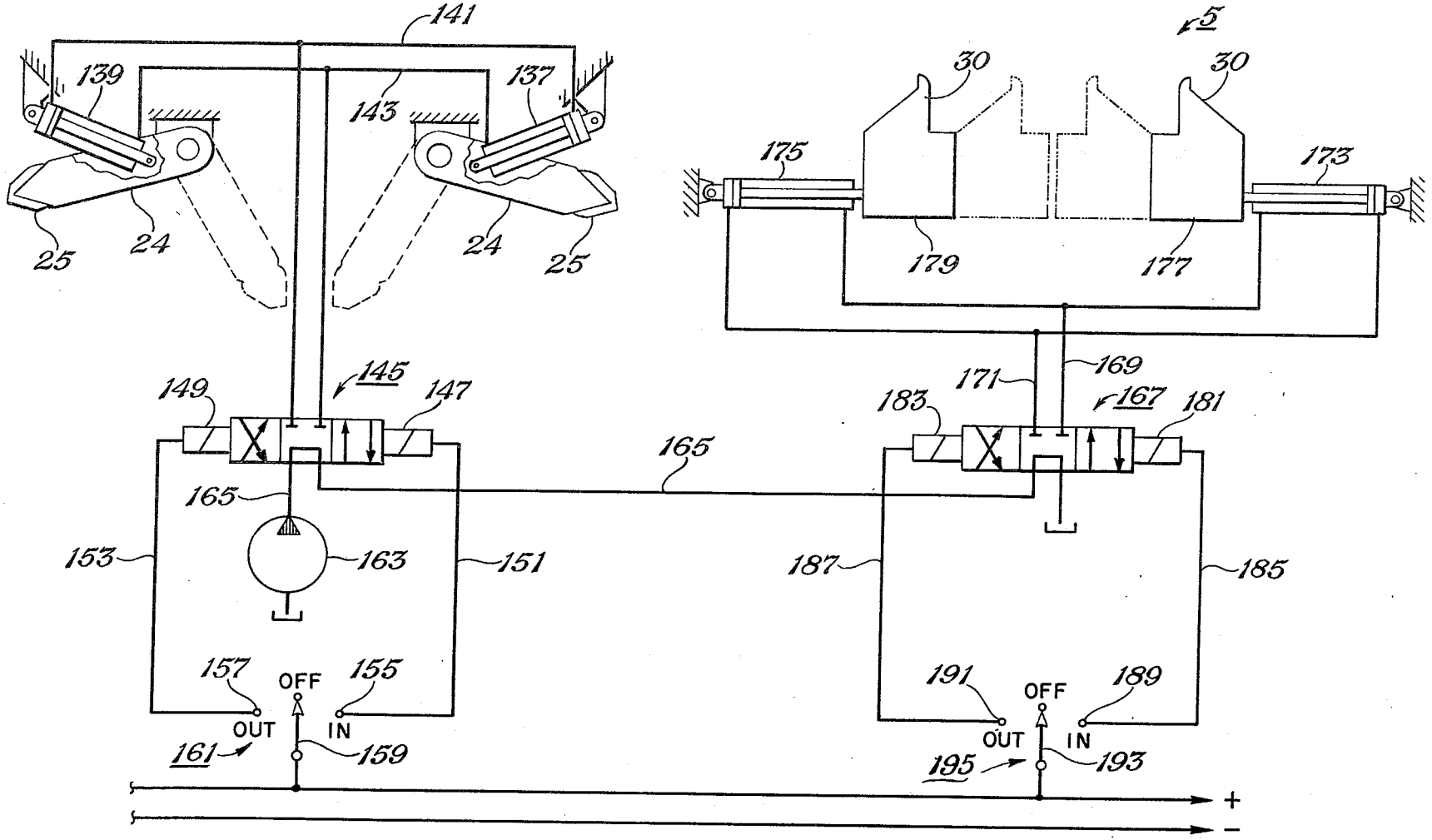
FIG. 3 is a schematic electro-hydraulic diagram, with break-out arms and slips shown schematically to show the preferred form of the system.

Break-out apparatus is shown schematically in FIG. 3, which shows the break-out arms 24 adapted for pivotal movement from a retracted to an engaging position, being powered by a pair of hydraulic cylinders 137, 139, each having one end mounted to the cross-member 13 that supports the power swivel 14. The cylinder end of each hydraulic cylinder is connected to a conduit 141, and the piston end of each cylinder is connected with a conductor 143, extending to a valve means 145, which as shown is a four-way, three-position solenoid operated directional valve of conventional construction adapted to direct fluid to and from the cylinders 137, 139 to retract or extend them. The solenoids 147, 149 are connected by conductors 151, 153 to terminals 155, 157 to be opened or closed by a pole 159 of a switch designated generally by the numeral 161.

The hydraulic pump 163 supplies fluid through hydraulic line 165 to the valve 145 and also to another valve 167, which is another four-way, three-position solenoid operated directional control valve of conventional construction. This valve directs hydraulic fluid through lines 169, 171 to respective ends of hydraulic cylinders 173, 175 to extend or retract separable sections 177, 179 of the slips 5 used as shown in FIG. 1 to suspend the drill stem section 7 and engage with fingers 30 the slots 26 in collar 9 of the drill stem. Solenoids 181, 183 are connected by conductors 185, 187 to terminals 189, 191 to be opened or closed by pole 193 of the switch 195.

In operation, movement of switch 45 to the drilling mode closes poles 43, 79, 113 and 99 respectively with terminals 131, 119, 105 and 98. Pump 115 is energized along with solenoid 127 to position valve 121 to supply fluid to and from the hydraulic cylinders 15, 17 to thrust the power swivel 14 downward as pole 134 is closed with terminal 130. Simultaneously, pressure compensator 101 is activated to establish a selected maximum output pressure for second pump 81, preferably 3000 psi (pound per square inch) for the machine illustrated to limit the output torque of the power swivel for drilling. The output 'volume of the pump may be selectively varied through the variable resistor 96, which controls the setting of control means 87. As a consequence, the pump 81 rotates the swivel 14 at a selected speed and torque is limited to a selected level.

To add a drill stem member 23, initially power swivel 14 must be broken from box 9 of drill stem 7. Switch 45 is moved initially to the off position when power swivel 14 is down and collar 26 aligned with slips 5. The "off" position positions poles 43, 79, 113, 99 against terminals 131, 119, 105, 98 to deenergize electrical components such that power swivel 14 and hydraulic cylinder 15, 17 movement ceases. Pole 193 is closed with terminal 189 (the in position) to move valve 167 into position to cause the fluid from pump 163 to urge sections 177, 179 of slips 5 against the drill stem as shown by the phantom lines in FIG. 3. While in the in position, the fingers 30 engage slots 26 in the collar 9. Switch 45 is moved to its break-out mode which closes poles 43, 79, 65 and 99 with terminals 39, 71 57 and 95. Drilling pump 115 is deactivated when switch 45 is moved to the break-out mode. Closing pole 43 with terminal 39 energizes solenoid 33 and moves valve 29 to a position to move the power swivel 14 upward. The closing of pole 79 with terminal 71 activates pressure compensator 67 of the first pump means 47 to establish a selected pressure in the hydraulic cylinders. Also, pole 65 closes with terminal 57 to energize through variable resistor 55 the first control means 51 to establish the selected output volume of the pump 47. The linear upward speed of the power swivel is thus determined. In additionn, when pole 99 closes with terminal 95 the second control means 87 is activated to a selected position through variable resistor 91 to determine the output volume of the second pump means 81 and the rotational speed of power swivel 14. The variable resistors 91 and 55 are adjusted to correlate power swivel 14 rotational and linear speeds with the particular drill stem and thread combination. Once determined for a particular drill stem, no further adjustment is required usually. Thus, swivel speed is matched with thread lead to prevent thread damage.

During the break-out of the threads of power swivel 14 from the threads of the box 9 of drill stem 7 with switch 45 in the break-out mode, pole 113 is in an open position. As a consequence, the third pressure control compensator 114 limits the pressure supplied by second pump 81 to power swivel 14. This is the highest limit and has a selected value in this instance of 5000 psi (pounds per square inch), which results in a maximum break-out torque of 160,000 ft.-lbs. being available between the power swivel 14 and the box 9 of drill section 7. Back-up is held on the drill stem by slips 5 as previously described.

After break-out, an additional drill stem member 23 must be added and readied for make-up. Although not illustrated in the drawing, the power swivel is adapted to pivot on the cross member 13 responsive to electro-hydraulic controls (not shown) to tilt the swivel and pick up a new section of drill stem and position it for make-up in the position shown for section 23 in FIG. 1. This procedure is not described in detail but will be apparent to those of average skill in the art in view of the described circuitry since the procedure is generally known. Generally, the section 23 may be made-up hand tight with the swivel, which is raised and lowered responsive to selected movement of pole 134 to the up or down position with switch 45 in the drill position. When the threads 28 of section 23 are positioned for make-up with those of box 9 of the lower section 7, switch 45 is positioned to its makeup mode whereby poles 43, 79, 65, 113 and 97 close respectively with terminals 41, 77, 59, 111 and 93. Therefore, solenoid 34 positions the valve 29 to urge cylinders 15, 17 downward. Also, second pressure compensator 73 limits the output pressure for its first pump means 47. With cross member 13 in the up position, switch 110 remains closed as shown in FIG. 2. Variable resistor 53 is adjusted such that the first control means 51 establishes the selected output volume for pump 47. Thus, the power swivel 14 moves downward with limited force at a selected speed. The swivel 14 is reversible, though not shown to be so in FIG. 2, and the output pressure of the second pump means 81 is established by activation of second pressure compensator 107, which has a selected setting of 4000 psi to result in an intermediate make-up torque at swivel 14 of 100,000 ft.-lbs. The output volume of pump 81 may be selectively varied with variable resistor 89 and second control means 87. Therefore, the make-up torque and rotational speed of the power swivel may be controlled. Swivel speed may be matched with thread lead to prevent thread damages. Further, the make-up torque is established at a value lower than the break-out torqure. During make-up, back-up is held on drill stem section 7 by engagement of the fingers 30 of sections 177, 179 (see FIG. 3) of slips 5 with slots 26 of collar 9 since pole 193 is in the in position in contact with terminal 189.

After make-up of a new section of drill stem, switch 45 is moved to the off or neutral position shown in FIG. 2 and pole 193 is closed with terminal 191 to enable retraction of slips 5. Then switch 45 is turned to drill and pole 134 is closed with terminal 130 to move the power swivel 14 and drill stem, as well as drill bit, downward to the bottom of the bore hole. Rotational speed of the swivel 14 during drilling is controlled by variable switch 96 which receives power from pole 99 through terminal 98. Rotary torque is limited by pressure compensator 101 which is connected to pole 113 through terminal 105 and preferably has a pressure setting of 3000 psi for the machine illustrated. This results in a drilling torque limit of 80,000 ft.-lbs. at the swivel, and thus establishes a third, lowest output torque limit.

When drilling has progressed such that the swivel 14 is in proximity with the work table 3, further downward movement is ceased by moving pole 134 to the off position to deactivate the hydraulic cylinders 15, 17. Then, variable resistor 96 is adjusted to bring slots 26 in the box 9 of the drill stem section 7 into alignment with fingers 30 of section 177, 179 of slips 5. When alignment has been achieved switch 45 is turned off and fingers 30 are engaged with slots 26 by movement of pole 193 to the in position and to engagement with terminal 189 to position valve 167 to urge the slips inward. If another drill stem section is desired, the operation previously described is repeated. If the hole is at the desired depth or if it is desired to pull the drill string out of the hole to change bits, the swivel 14 is further tightened with the threads of box 9 to the maximum torque of 160,000 ft.-lbs. with the slips 5 acting as a backup. This will insure that the lower threads 28 of the upper drill section 23 break out with respect to the adjacent drill stem section 7 when they are subsequently to be separated, as will become more fully apparent hereinafter. With the slips 5 engaging the pipe by operation as previously described, to further tighten the power swivel 14, switch 45 is positioned in the previously described make-up mode, which ordinarily would impress a pressure of 4000 psi across the swivel 14 and result in a make-up torque of 100,000 ft.-lbs. However, with the cross member 13 in its downward most position, mechanically operated switch 110 is mechanically actuated to the open position by engagement with the actuator 108 associated with the swivel assembly as shown in FIG. 2. This deenergizes the 4000 psi pressure compensator 107 and automatically results in the third pressure compensator 114 controlling the pressure in the pump to the maximum 5000 psi. This results in a maximum make-up torque of 160,000 ft.-lbs. being applied.

Then switch 45 is moved drill position and the drill stem is lifted and rotated to bring box 9 of the next lowest drill section through the work table 3, so that slips 5 can be closed such that fingers 30 engage slots 26 in the box by movement of pole 193 to the in position as previously described. Then switch 45 is moved to the break-out mode, which as previously described, applies up to 160,000 ft.-lbs. of torque between the swivel 14 and the box 9 of the lower drill stem section 7. Since the swivel is made-up with the box 9 of the upper drill stem section 23 with 160,000 ft.-lbs. of torque, and since the connection between the upper drill stem section 23 and lower drill stem section 7 is made-up to only 100,000 ft.-lbs. of torque, it is assured that the lower connection will break-out. Then, the upper section 23 may be laid down and broken-out from the swivel 14 with the break-out arms 24. This is accomplished by moving pole 159 (see FIG. 3) into contact with terminal 155 to energize solenoid 147 to position valve 145 to extend the hydraulic cylinders 137, 139 and move break-out arms 24 24 until fingers 25 engage the slots 26 in the collar 9. After break-out, pole 159 is moved to contact 157 to retract the arms 24. The above sequence is repeated until all the drill stem is removed from the bore hole.

It should be apparent from the foregoing description that an invention of significant advantages has been provided. As explained in my copending application, thread damage is avoided by the provision of advantageous means to correlate rotational and linear speeds of the swivel to match the thread lead of the threaded connectors of the drill stem. The make-up and break-out system assures break-out through utilization of a largest, an intermediate, and a smallest torque, the smallest torque being used for drilling, the intermediate torque for make-up and largest for break-out. Thus, the break-out torque is always sufficient to overcome the make-up torque generated by the machine directly or that caused indirectly by drilling. The break-out procedure for removing drill stem from the hole is advantageous because break-out is assured at the lowest connection of the uppermost section of drill stem, while preventing break-out between the swivel and the top of the uppermost section. This is accomplished by making-up the swivel with the top of the uppermost section with the largest torque, raising the drill stem, setting slips and holding a back-up on the adjoining section of drill stem, and then breaking the connection between adjoining sections, which is made-up with the intermediate make-up torque and must therefore break-out rather than the connection between swivel and the drill stem. The use of arms and slips with fingers that engage generally vertical slots in the collars of the drill stem is advantageous in permitting use of large break-out and make-up torques without damage. The use of vertical slots in the collars and matching fingers in the break-out means results in easier alignment and reduced upsetting and wear of the engaged metal of the fingers and the slots.

While I have shown my invention in only its preferred form, it should be apparent to those skilled in the art that it is not limited to this particular form but is susceptible to various changes and modifications without departing from the spirit thereof.

I claim:

1. In an earth boring machine having a hydraulic and reversible swivel, powered for reciprocable movement with a cross member along a mast to move a drill stem and a drill through a work table and in a bore hole, the improvement comprising:

pump means having three output pressure limits selectively applied to the power swivel to produce a largest, an intermediate and a smallest output torque limit;

break-out means carried by the cross member and having arms to engage slots on the drill stem to enable break-out between the power swivel and the drill stem;

slip means carried by the work table to support the drill stem when disconnected from the power swivel and to selectively engage slots in the drill stem to permit make-up and break-out; and control means connected with the pump means to establish the smallest torque limit for drilling, the intermediate torque limit for make-up, and the largest torque limit for break-out and for make-up of the power swivel with the drill stem when removing the drill stem from the hole.

2. The machine defined by claim 1 wherein the pump means has three pressure compensators to establish said three output pressure.

3. The machine defined by claim 2 wherein the control means includes switch means for deactivating the pressure compensator that establishes the intermediate output torque limit when the cross member and power swivel are positioned downward causing the largest output torque to make-up the swivel with the uppermost drill stem to assure break-out of the connection between drill stem members, since these are made-up only to the intermediate torque limit.

4. In an earth boring machine having a hydraulic and reversible swivel, powered for reciprocable movement with a cross member along a mast to move a plurality of drill stem members and a drill bit through a work table and in a bore hole, the improvement comprising:

pump means having three output pressure limits selectively applied to the power swivel to produce a largest, an intermediate and a smallest output torque limit;

slip means carried by the work table to support the drill stem members when disconnected from the power swivel and to selectively engage one of the drill stem members for make-up and break-out;

control means connected with the pump means, for establishing the smallest torque limit during drilling operation, the intermediate torque limit during make-up operation, and the largest torque limit during break-out procedures; and switch means connected with the control means and operable when drawing the drill stem members out of the bore hole by placing the power swivel in make-up operation when the power swivel is at its lowest position adjacent the work table, for causing the pump means to produce the largest torque to tighten the connection between the uppermost drill stem member and the power swivel to the largest torque, assuring break-out of the connection between the uppermost drill stem member and the second drill stem member, which is made-up only to the intermediate torque limit.

* * * * *